US005367855A

United States Patent [19]

DeWaters

[11] Patent Number: 5,367,855

[45] Date of Patent: Nov. 29, 1994

[54] METHOD AND APPARATUS FOR SEALING A LID AND CONTAINER WITH SEALING TAPE

[76] Inventor: William J. DeWaters, 99 Harvest Rd., Levittown, Pa. 19056

[21] Appl. No.: 967,252

[22] Filed: Oct. 26, 1992

[51] Int. Cl.[5] ..... B65B 51/06

[52] U.S. Cl. ..... 53/137.2; 53/138.1; 53/214; 53/587; 156/458; 156/468; 156/552

[58] Field of Search ..... 53/137.2, 138.1, 419, 53/420, 587, 399, 214; 156/69, 391, 447, 458, 468, 475, 552

[56] References Cited

U.S. PATENT DOCUMENTS

| | | | |
|---|---|---|---|
| 2,220,381 | 11/1940 | Wilson | 156/552 X |
| 2,227,171 | 12/1940 | Anderson | 156/552 X |
| 2,258,185 | 10/1941 | Lyon | 53/137.2 X |
| 2,269,621 | 1/1942 | Davis et al. | 53/137.2 |
| 2,334,224 | 11/1943 | Socke | 156/552 X |
| 2,504,060 | 4/1950 | Weber . | |
| 2,563,542 | 8/1951 | Mackelduff . | |
| 2,732,115 | 1/1956 | Allen . | |
| 2,840,968 | 7/1958 | Clement | 53/137.2 |
| 3,555,764 | 1/1971 | Dowling | 53/137.2 X |
| 3,555,767 | 1/1971 | Huffman . | |
| 3,676,271 | 7/1972 | Hake et al. . | |
| 3,851,443 | 12/1974 | Fine . | |
| 3,873,018 | 3/1975 | Donnay | 53/137.2 X |
| 4,111,737 | 9/1978 | Wesley | 156/458 |
| 4,141,195 | 2/1979 | Mueller et al. . | |
| 4,591,403 | 5/1986 | Von-Meyer | 156/458 X |
| 4,735,033 | 4/1988 | Stackhouse | 53/587 X |
| 4,845,920 | 7/1989 | Lancaster | 53/587 X |
| 4,994,129 | 2/1991 | Nakagaki | 156/69 |

FOREIGN PATENT DOCUMENTS

| | | | |
|---|---|---|---|
| 2101307 | 11/1977 | Germany | 53/137.2 |

*Primary Examiner*—John Sipos
*Assistant Examiner*—Daniel Moon
*Attorney, Agent, or Firm*—Bell, Seltzer, Park & Gibson

[57] ABSTRACT

A container sealer and associated method are disclosed for successively applying a sealing tape to a seam between a lid and a container body for a plurality of containers and their respective lids. The sealer comprises a conveyor for advancing a plurality of generally circular containers along a substantially linear and substantially horizontal predetermined path of travel; idler rollers for temporarily holding a single container in an upright and stationary position along the predetermined path of travel; and a movable tape head operatively associated with and adjacent the idler rollers, the movable tape head being movable between a tape-applying position adjacent the predetermined path of travel and a retracted position removed from the predetermined path of travel, for applying a predetermined length of sealing tape to a held and rotating container adjacent idler rollers, the length of the sealing tape being measured in relation to a circumference of each container.

14 Claims, 7 Drawing Sheets

METHOD AND APPARATUS FOR SEALING A LID AND CONTAINER WITH SEALING TAPE

FIELD OF THE INVENTION

The present invention relates to a method and apparatus for sealing containers, and in particular relates to a method and apparatus for successively applying sealing tape to cylindrical lidded containers.

BACKGROUND OF THE INVENTION

The present invention relates to applying tamper evident seals to relatively large diameter lidded circular containers. Typical examples are those containers used for popcorn, pretzels, or potato chips. In general, the seal for such containers takes the form of an adhesive tape covering the seam between the lid and the body of the container.

Particular problems arise when sealing such containers. One problem arises from the typical rolled lip construction of the lid, and the lipped or ridged shape of the upper portions of the cylindrical container which receive the lid. Because of these typical structures, the containers cannot always be handled as perfect cylinders.

Some previous sealing devices have tended to use a turntable type arrangement in which the cylinder to be sealed, travels in a circular path during which a strip of sealant material such as tape is applied to it. Although useful in certain circumstances, the turntables tend to occupy significant space and offer very little flexibility in terms of different sizes of containers. Such containers, however, vary widely in their dimensions—height and diameter—and these and other devices are often limited to handling only a single size of container.

Other devices are appropriate for sealing one container at a time, but require constant manual attention to remove a sealed container and replace it with an unsealed container to be sealed.

In other arrangements, the containers to be sealed must be raised or lowered during the sealing and lidding process, a procedure which greatly complicates the mechanical design of the resulting device.

In yet other arrangements, the adhesive tape sealing the container is moved in an orbital fashion around a stationary container. This likewise takes up a great deal of space and complicates the necessary arrangements.

Such prior devices have also lacked simple and effective indexing elements; i.e. elements that present the containers for sealing at regular intervals even when they arrive at irregular intervals.

Therefore, the need exists for a fairly simple and straightforward method and associated apparatus for applying a sealing tape to lidded containers. In particular, the need exists for a method and apparatus which can appropriately index and then seal containers of different diameters and different heights, but without the need for overly complex techniques.

OBJECT AND SUMMARY OF THE INVENTION

Therefore, it is an object of the present invention to provide a container sealer and associated method for successively applying a sealing tape to the lid and the container body for a plurality of containers and their respective lids.

The invention meets this object with an apparatus comprising means for advancing a plurality of generally circular containers along a substantially linear and substantially horizontal path, means for temporarily holding a single container in an upright and stationary position along the linear horizontal path relative to the advancement means, and taping means operatively associated with and adjacent the holding means. Portions of the taping means are movable between a tape applying position adjacent the linear horizontal path and a retracted position removed from the linear horizontal path, and apply a predetermined length of sealing tape to successive containers as they reach and are held at the holding means.

In another embodiment, the invention comprises a method of sealing containers while they are being advanced in a substantially horizontal, substantially linear path of travel. The method comprises temporarily holding one of the successive containers in a stationary position along the path of travel, engaging a tape supply against the container, rotating the container to draw the tape into sealing position around the container to thereby apply a tape seal to the container, and then severing the applied tape from the tape supply.

The foregoing and other objects, advantages and features of the invention, and the manner in which the same are accomplished, will become more readily apparent upon consideration of the following detailed description of the invention taken in conjunction with the accompanying drawings, which illustrate preferred and exemplary embodiments, and wherein:

DETAILED DESCRIPTION OF THE ILLUSTRATED EMBODIMENTS

Figure 1:
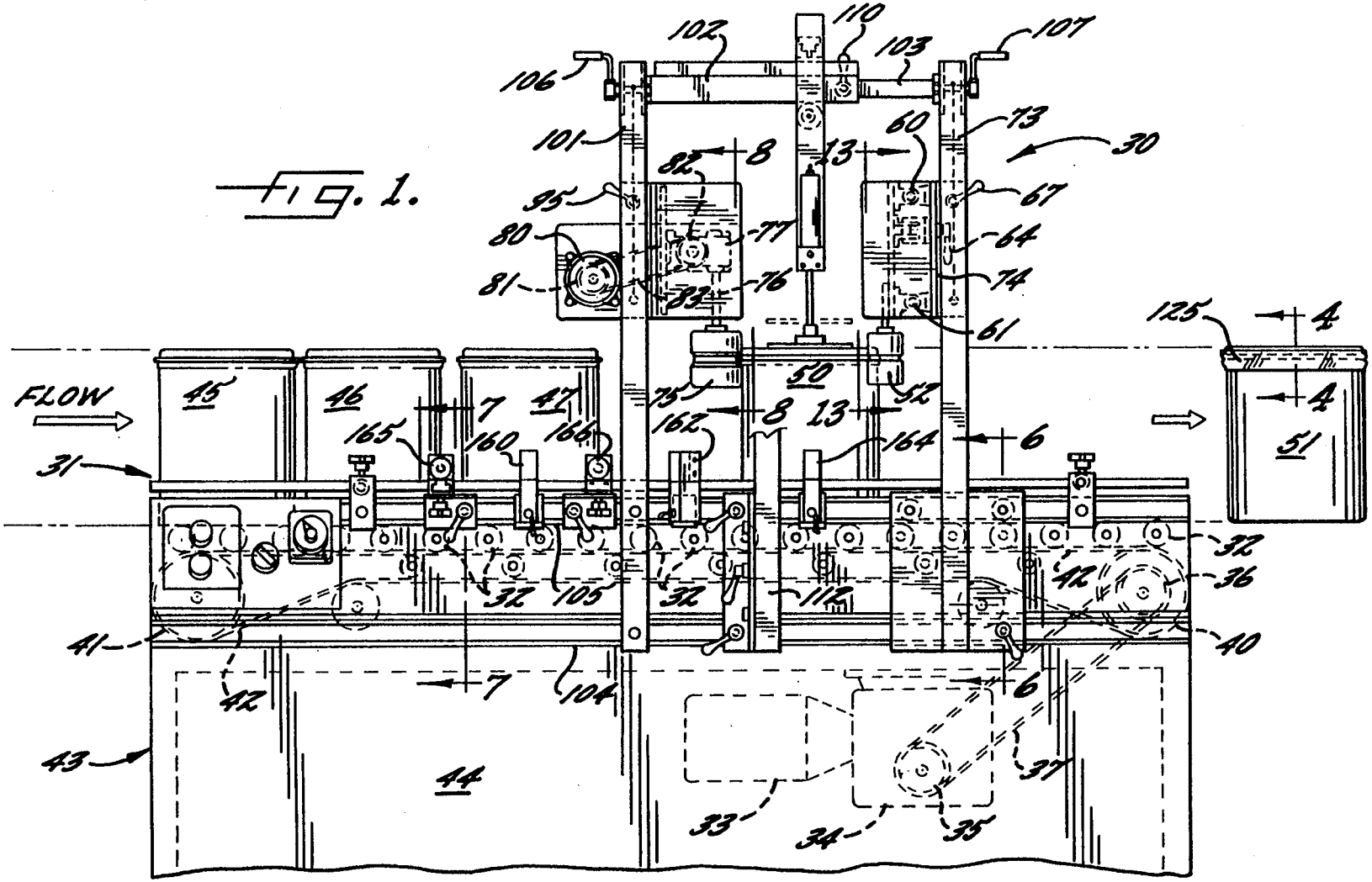
FIG. 1 is a side elevational view of the apparatus of the present invention.

FIG. 1 is a side elevational view of the container sealer of the present invention and broadly designated at 30. The sealer 30 comprises means for advancing a plurality of generally circular containers along a substantially linear and horizontal path. In the preferred embodiments, the advancing means comprises a roller conveyor broadly designated at 31 formed by the individual rollers 32 and wherein at least some of the rollers 32 are driven rollers. The rollers can be driven by any appropriate means such as the motor 33 illustrated in FIG. 1, the gear box 34, the pulleys 35 and 36, the pulley belt 37, the drive pulleys 40 and 41, and the drive belt 42.

FIG. 1 illustrates that the roller conveyor, as well as a number of other elements of the invention described hereinbelow are supported on a frame 43 which, in the illustrated embodiment, has a covering 44 in the form of a metal sheet over the lower internal portions of the sealer 30. FIG. 1 further illustrates that the conveyor 31. advances a plurality of containers designated for descriptive purposes as 45, 46, 47, 50, and 51 along a substantially linear, substantially horizontal path of travel. The conveyor 31 defines a downstream direction in which the conveyor travels, and an upstream direction opposite to the conveyor's direction of travel. Thus, the arrows labeled "flow" in the drawings illustrate the downstream direction.

CONTAINER POSITIONING

FIG. 1 also illustrates that the invention comprises means for temporarily holding a single container in an upright and stationary position along the linear horizontal path relative to the advancing means. In particular, the preferred holding means comprises a pair of idler rollers, 52 and 53 that are positioned above the conveyor 31 and along the path of travel of the containers. The rollers 52 and 53 are movable between a closed position in which they are less than one container diameter apart to thereby prevent a container from passing therebetween, and an open position in which the idler rollers 52 and 53 are greater than one container diameter apart to thereby allow a container to pass therebetween. When the rollers 52 and 53 are in their closed position, they permit the container 50 to rotate on its own bottom while being held and taped in a manner described hereinbelow, and for releasing the container downstream thereafter.

Figure 2:
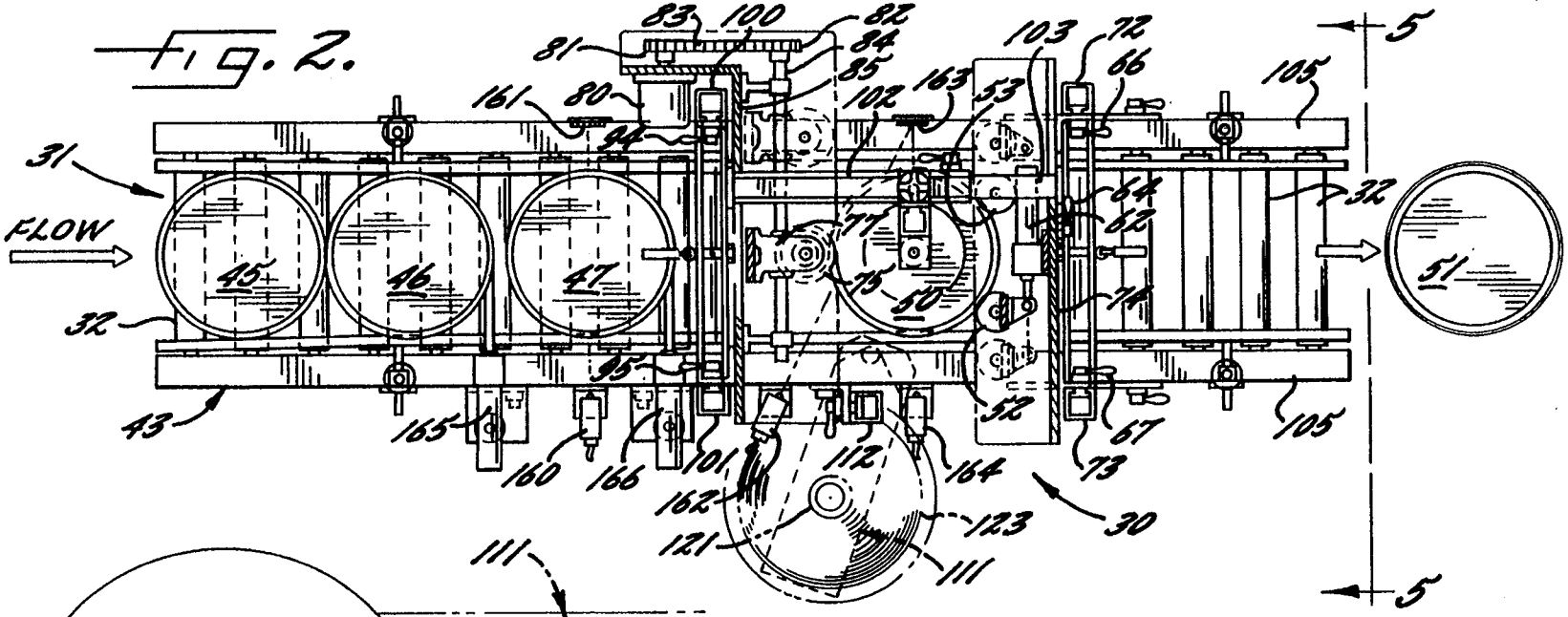
FIG. 2 is a top plan view of the apparatus of the present invention.
Figure 3:
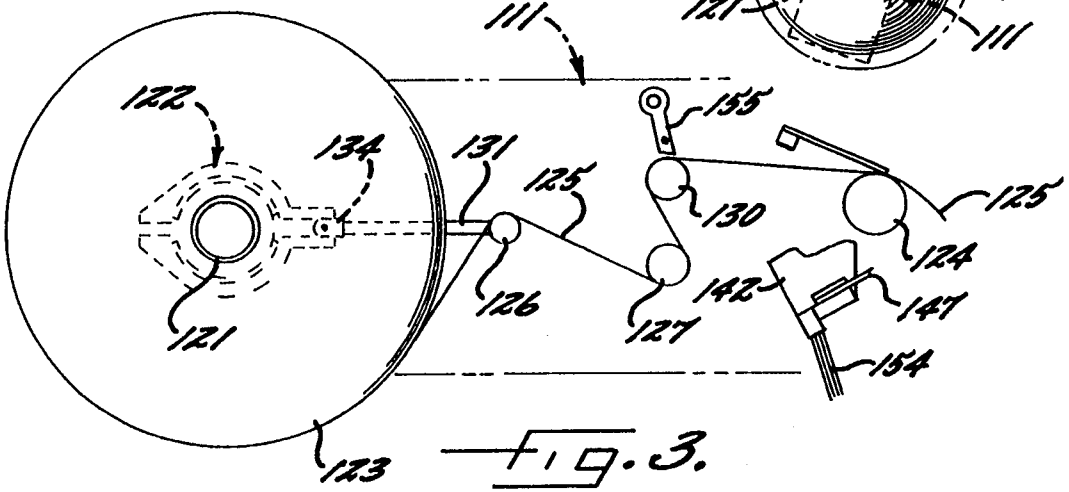
FIG. 3 is a partial schematic view of the tape application mechanism of the present invention.

This alternative relationship of the rollers 52 and 53 to one another is best illustrated in FIG. 2. Further to the preferred embodiments, the respective positions of the idler rollers 52 and 53 are adjustable with respect to the conveyor 31 to thereby accommodate containers of various sizes for being sealed. In particular, the container sealer comprises means for vertically and horizontally ,adjusting the closed position of the idler rollers with respect to the conveyor to thereby hold and seal containers of varying diameters and varying heights.

Figure 5:
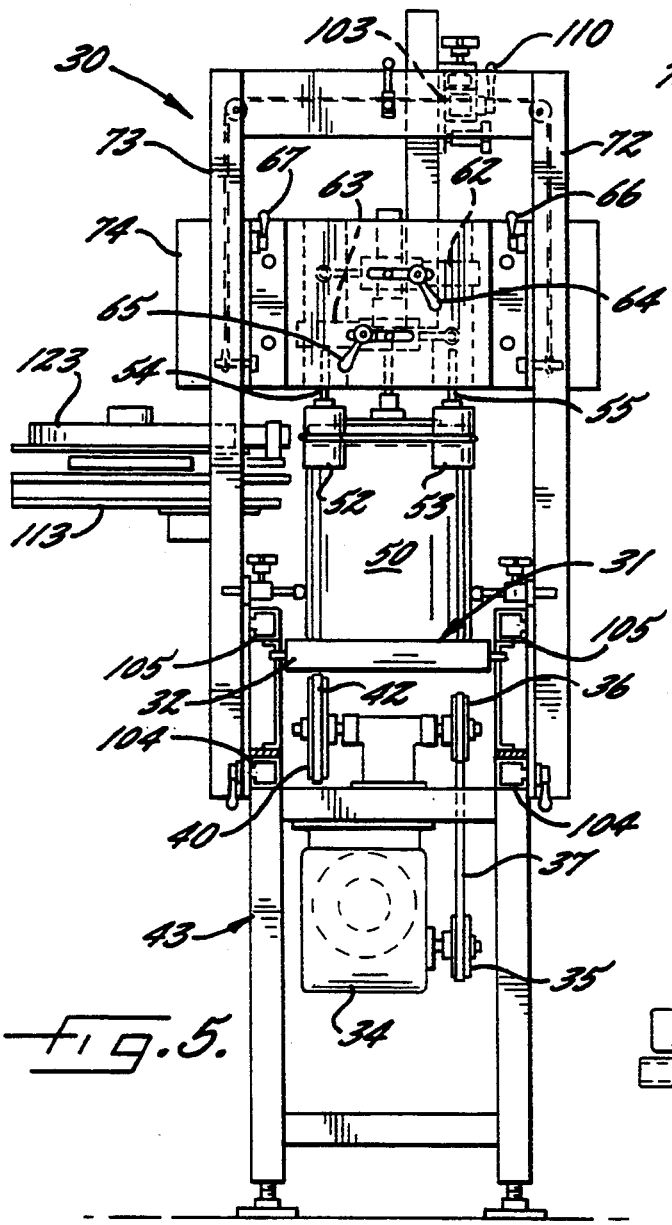
FIG. 5 is a side elevational view taken along lines 5—5 of FIG. 2.
Figure 6:
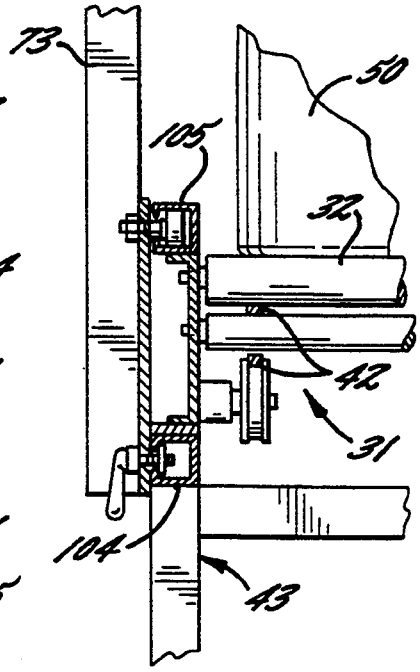
FIG. 6 is a partial cross-sectional view taken along lines 6—6 of FIG. 1.
Figure 4:
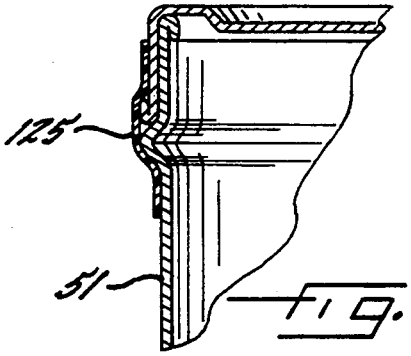
FIG. 4 is a partial cross-sectional view taken along lines 4—4 of FIG. 4.
Figure 7:
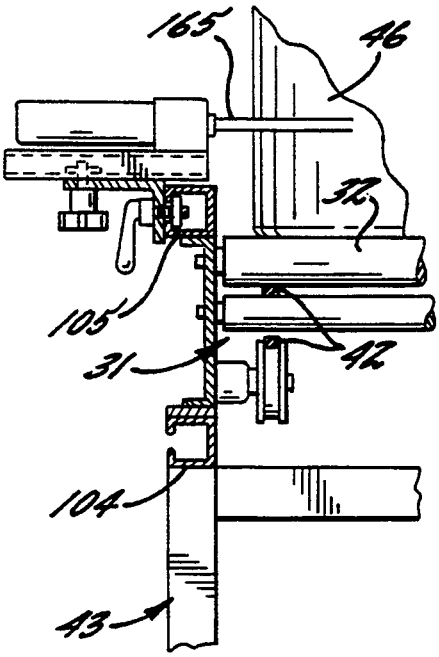
FIG. 7 is a partial cross-sectional view taken along lines 7—7 of FIG. 1.
Figure 13:
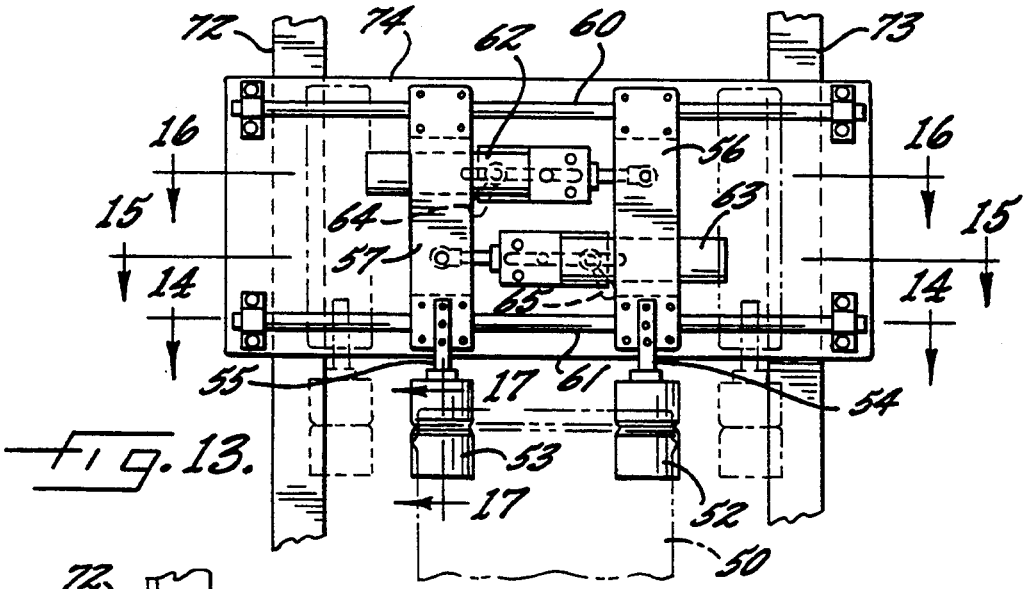
FIG. 13 is partial cross-sectional view taken along lines 13—13 of FIG. 1.
Figure 14:
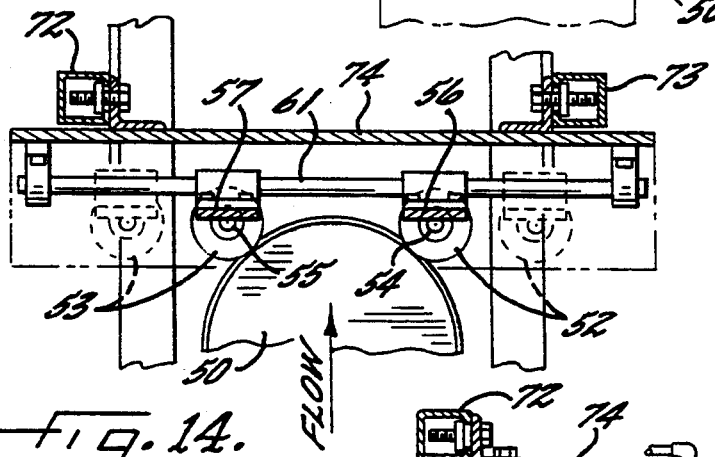
FIG. 14 is a partial cross-sectional view taken along lines 14—14 of FIG. 13.
Figure 15:
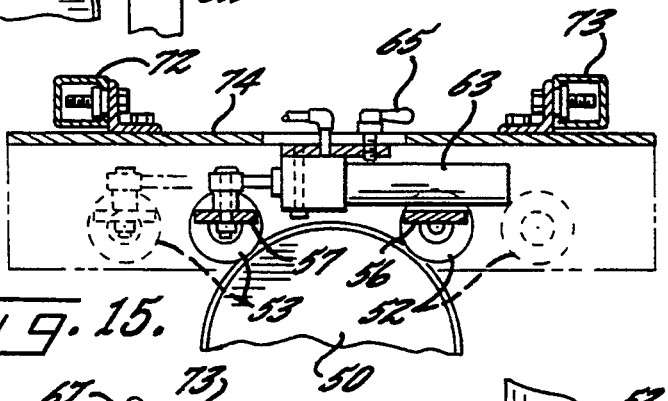
FIG. 15 is a cross-sectional view taken along lines 15—15 of FIG. 13.

FIGS. 5 and 13 best illustrate these adjustable features, and show that the rollers 52 and 53, illustrated in engagement with the container designated at 50, are positioned upon respective shafts 54 and 55. As further illustrated in FIG. 13, the shafts in turn are upon movable plates 56 and 57. The plates ride on the respective shafts 60 and 61 and define a path of travel for the rollers 52 and 53 when they open and close to either hold a container such as 50 in place or allow it to pass under the urging of the conveyor 31. It will be seen that in turn the plates 56 and 57 are driven by appropriate cylinders 62 and 63. The cylinders 62 and 63 are in turn mounted on the plate 74 in a manner that permits the relative positioning and motioning of the rollers 52 and 53 as well as their adjustment as described herein. FIG. 13 illustrates that the positions of the cylinders—and thus of the plates, the shafts and the rollers 52 and 53—can be adjusted laterally with respect to the diameter of the container 50 using the adjustment handles and appropriate tightening bolts in a manner that will be well understood by anyone familiar with such relatively simple attachments. For the sake of clarity, the handles have been designated at 64 and 65, but the other remaining details of the tightening screws will not be set forth herein, although clearly set forth in FIGS. 15 and 16.

Figure 16:
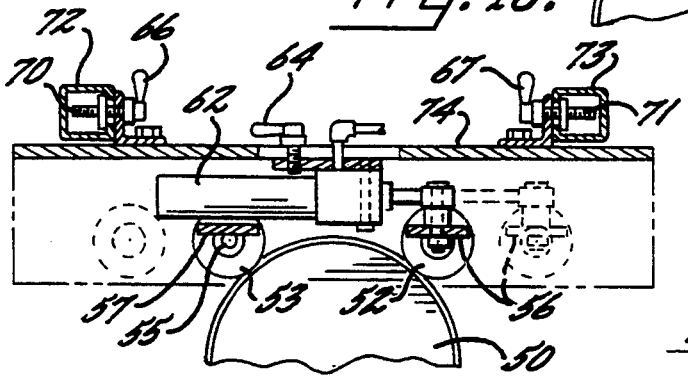
FIG. 16 is a partial cross-sectional view taken along lines 16—16 of FIG. 13.
Figure 17:
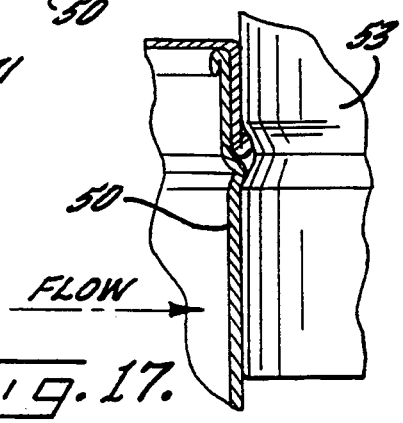
FIG. 17 is a partial cross-sectional view taken along lines 17—17 of FIG. 13.

FIG. 16 further shows that the vertical position of the idler rollers 52 and 53 can be adjusted by using the additional handles 66 and 67 and their appropriate tightening screws 70 and 71 which mount the rollers and the associated apparatus on upright portions 72 and 73 of the container sealer 30.

TAPING

The invention further comprises taping means operatively associated with and adjacent to the holding means. Portions of the taping means are movable between the tape applying position adjacent the linear horizontal path and a retracted position removed from the linear horizontal path. The tape means apply a predetermined length of sealing tape to successive containers as they reach and are held at the holding means.

In a preferred embodiment, one portion of the taping means comprises a drive roller 75 (FIG. 1) adjacent the idler rollers 52 and 53 for rotating the container 50 at the idlers 52 and 53 while other portions of the taping means apply tape to the container. As in the case of the idler rollers 52 and 53 that serve as the holding means, the position of the drive roller 75 is adjustable with respect to the conveyor 31 and with respect to the idler rollers 52 and 53 to accommodate containers of varying heights and diameters. In the most preferred embodiments, these comprise means for vertically and horizontally adjusting the drive position of the drive roller 75 with respect to the conveyor 31 to thereby rotate and seal containers of varying diameters and varying heights. These adjustment features are best shown in FIGS. 1 and 8–12. These drawings illustrate that the drive roller 75 is connected by a shaft 76 to a gearbox 77. In turn, the gearbox is driven by a motor 80 through a pair of pulleys 81 and 82 and the pulley belt 83. FIG. 2 illustrates that the motor 80 and the pulleys 81 and 82, and the pulley belt 83 are offset from the conveyor 3 and drive the gearbox 77 and thus the shaft 76 and the drive roller 75 through a horizontal drive shaft 84 best illustrated in FIG. 2. In turn, all of these elements with respect to the drive roller 75 are mounted on a plate 85, the operation and use of which is best illustrated in FIGS. 8–11. In other embodiments, a chain and pinion drive for the roller 75 can also be incorporated as an alternative to the gearbox 77 and shaft 76.

Figure 8:
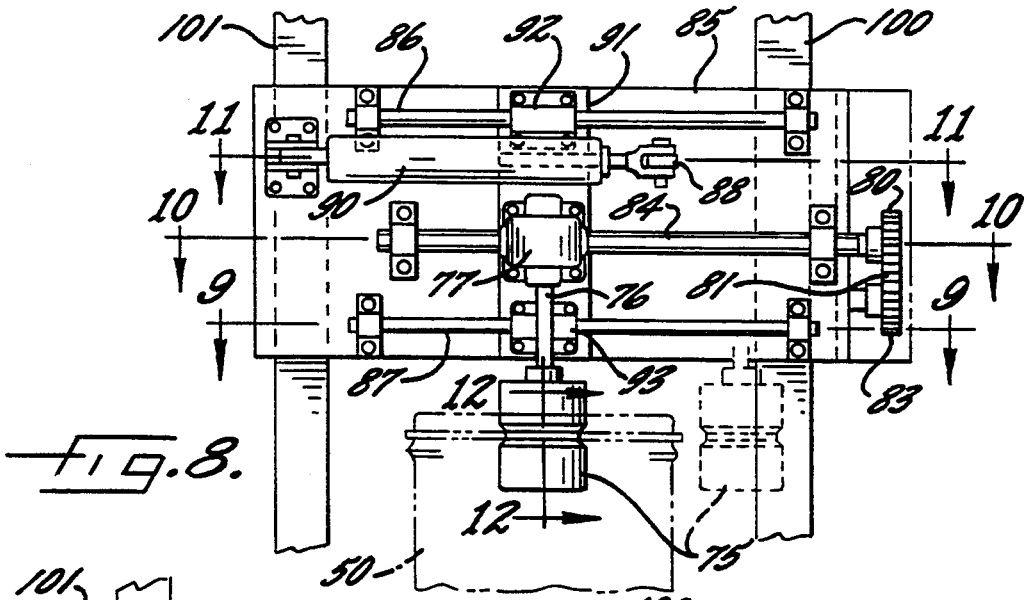
FIG. 8 is a partial cross-sectional view taken along lines 8—8 of FIG. 1.
Figure 9:
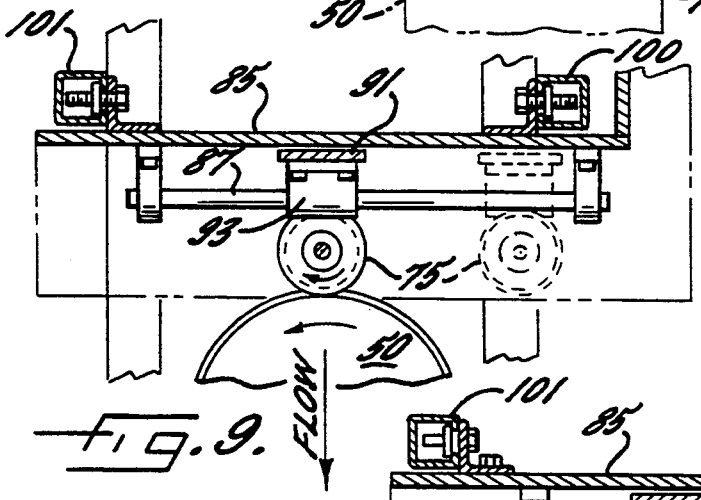
FIG. 9 is a cross-sectional view taken along lines 9—9 of FIG. 8.
Figure 10:
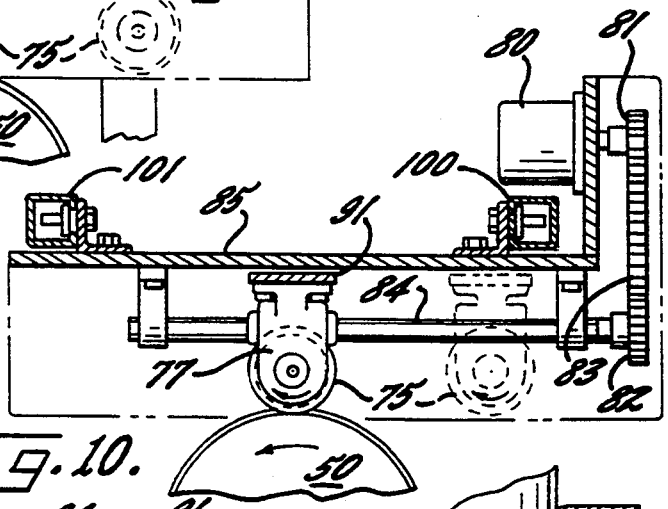
FIG. 10 is a cross-sectional view taken along lines 10—10 of FIG. 8.

FIG. 8 illustrates that in addition to the plate 85, parallel shafts 86 and 87 are also included and help guide the movement of the gearbox 77 and thus the drive roller 75. In the illustrated embodiment the drive roller 75 is positioned upstream of the holding means; i.e. the idlers 52 and 53. Thus, FIGS. 8 and 9 illustrates that in order for a container such as 50 to move into position to be taped, the drive roller 75 must initially move laterally out of the path of travel of the conveyor 31.

FIG. 8 illustrates that the appropriate movement of the drive roller 75 and the associated elements into and out of engagement with the container is accomplished through the use of a cylinder 90 which drives an arm 88 that in turn is fixed to the mounting plate 91 upon which the gearbox 77 is fixed. The additional travelers 92 and 93 help guide the entire drive roller assembly along the shafts 86 and 87, respectively.

Figure 11:
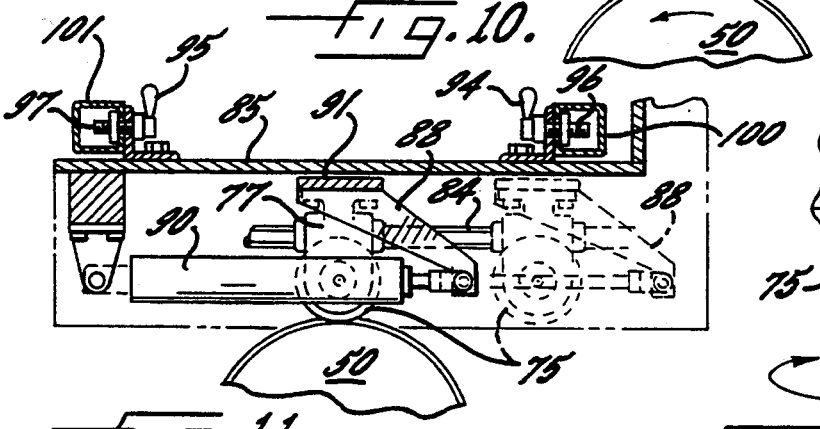
FIG. 11 is a partial cross-sectional view taken along lines 11—11 of FIG. 8.
Figure 12:
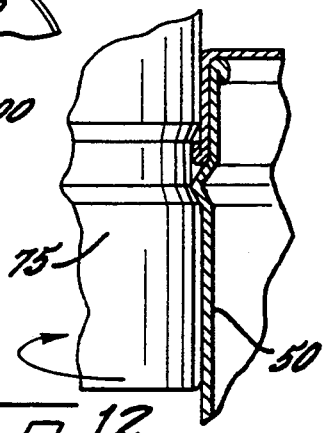
FIG. 12 is a partial cross-sectional view taken along lines 12—12 of FIG. 8.

FIG. 11 shows that the vertical position of the drive roller 75 can be adjusted using a set of handles 94 and 95 similar to those described earlier with respect to the positioning adjustment of the idler rollers 52 and 53. As in that structure, the handles 94 and 95 can tighten or loosen the appropriate bolts 96 and 97 with respect to upright members 100 and 101 which are opposite from and parallel to the upright members 72 and 73.

As a further detail, in the preferred embodiments, and as illustrated in the drawings, the rollers 52, 53, and 75 each include a center groove (FIG. 12) conforming to the shape of upper portions of a container, to thereby better engage, hold, rotate, and tape containers.

One other adjustment is necessary in order to accommodate containers of varying sizes; the distance between the drive roller 75 and the idler rollers 52 and 53. Specifically, this distance needs to reflect the diameter of the container 50. In this regard, upright members 72 and 73 are laterally adjustable with respect to upright members 100 and 101. In particular, upper portions of the apparatus 30 include a telescoping arrangement formed of frame members 102 and 103 that connect members 72 and 73 with members 100 and 101. At lower portions adjacent the conveyor 31, the upright members are movable along horizontal railings 104 and 105. The telescoping members 102 and 103 can be adjusted using the respective handles 106 and 107 which can telescope the frame members 102 and 103 in any appropriate fashion along with the tightening handle 110 (and a related bolt) also illustrated in FIG. 1.

The taping means further comprises movable portions which include an elongate arm, means for reciprocating the elongate arm between a tape applying position and a retracted position, a tape supply on the elongate arm, means for severing a predetermined length of tape from the tape supply and from the elongate arm after the predetermined length of tape has been applied to a container, and means for maintaining an appropriate tension on the tape as it is being applied to a container and severed from the tape supply. The elongate arm further comprises a tape head which is the portion movable between the taping position adjacent the path of travel of the conveyor 31 and the retracted position removed somewhat from the path of travel of the conveyor 31 for applying tape to a container such as 50 when the container is adjacent the tape head and the tape head is at the taping position.

Figure 18:
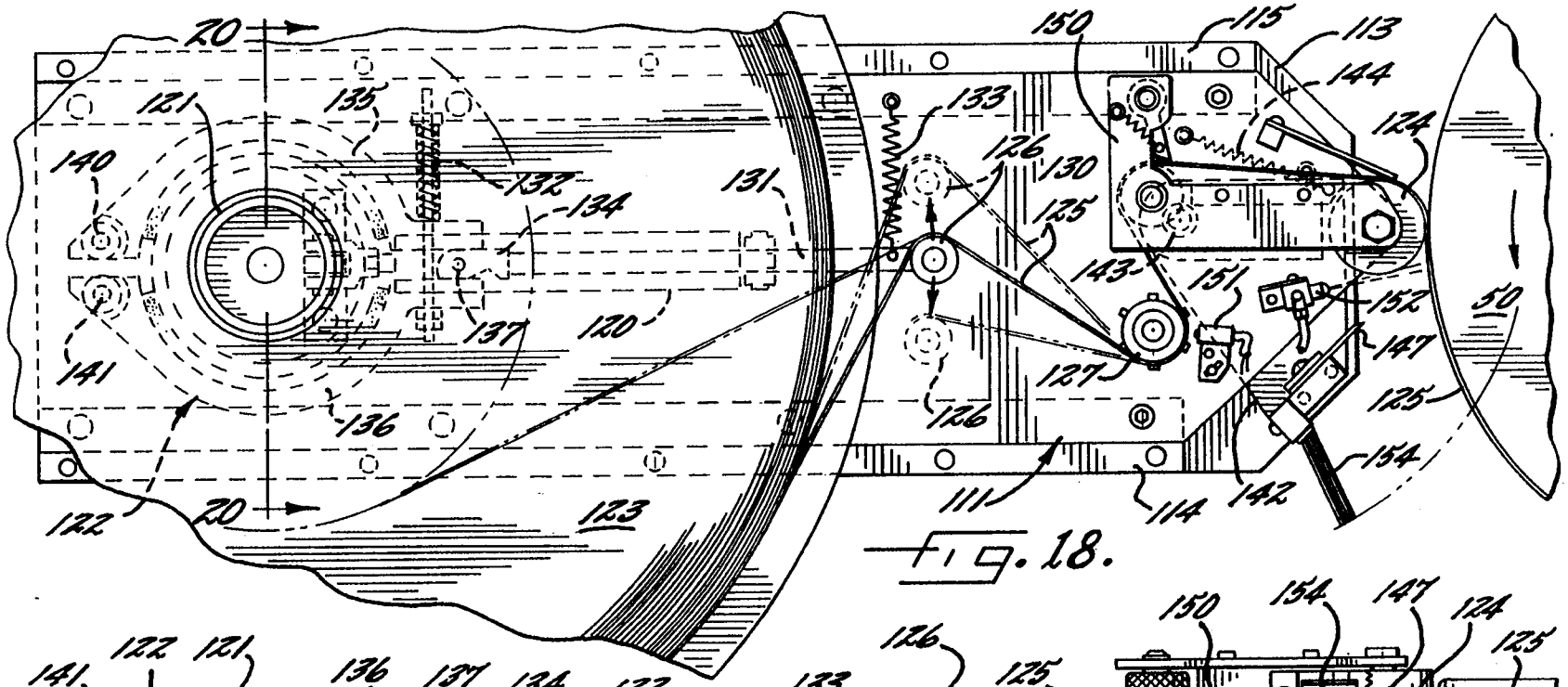
FIG. 18 is a top plan view of the tape application and cutting mechanism of the present invention.
Figure 19:
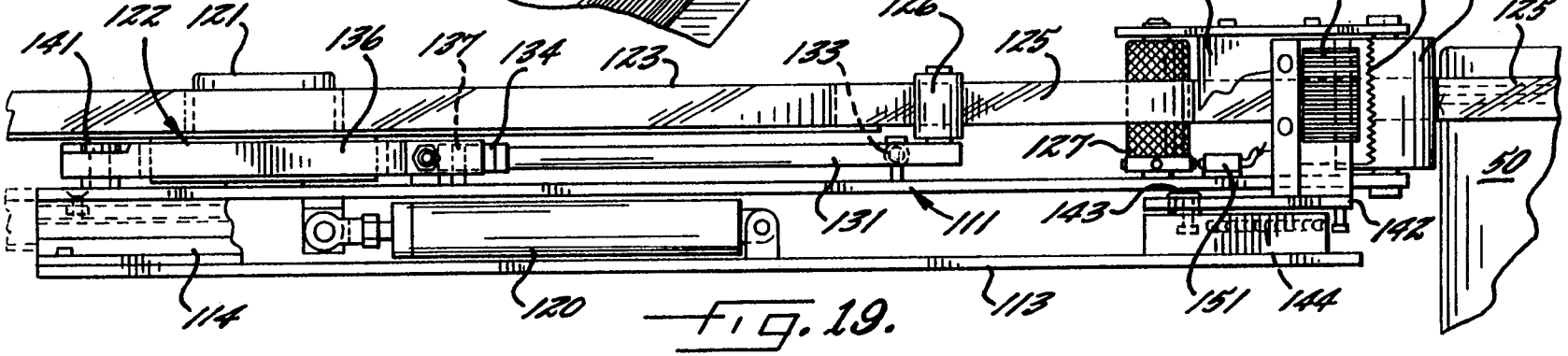
FIG. 19 is a side elevational view of the tape cutting mechanism shown in FIG. 18.
Figure 20:
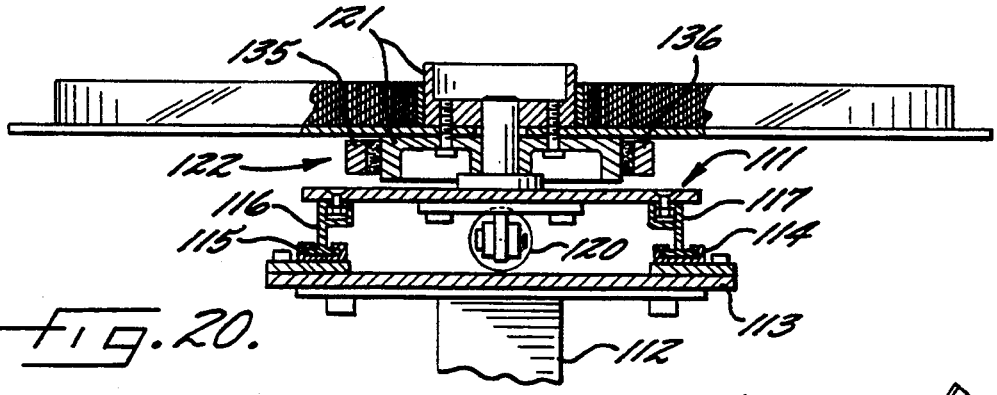
FIG. 20 is a cross-sectional view of the tape cutting mechanism taken along lines 20—20 of FIG. 18.

The tape head is horizontally movable between the respective taping and retracted positions and comprises a horizontal platform 111 for moving between the taping position and the retracted position. One end of the platform 111 defines a taping end and the opposite end of the platform 111 defines the supply end. In particular, the horizontal platform is slideably movable. As best illustrated in FIGS. 18, 19 and 20, a supporting member 112 is adjacent the conveyor and carries a horizontally oriented stationary plate 113 substantially parallel to and beneath the horizontal platform 111. The stationary plate 113 carries a pair of parallel tracks 114 and 115. A pair of rails 116 and 117 depend from the horizontal platform 111 and are slideably positioned against the respective parallel tracks 115 and 114. This structure permits the horizontal platform 111 to slide with respect to and in parallel orientation with the stationary plate 113 and in turn with respect to the conveyor 31.

A cylinder 120 drives the platform 111 between the taping position and the retracted position. The platform 111 carries a tape supply hub 121 adjacent the supply end. A brake shoe 122 bears against and brakes the hub 121 and the hub 121 carries the tape supply 123. The supply hub 121 and the brake shoe 122 are both substantially circular. The driving cylinder 120 is positioned between the platform 111 and the stationary plate 113 and is connected to both the stationary plate 113 and the horizontal platform 111.

The tape head further comprises means for directing tape from the tape supply 123 to a container such as 50 when the container 50 and the tape head are in the taping position. In particular, the tape directing means comprises a taping roller 124 (FIGS. 21 and 22) at the taping end of the horizontal platform 111 for applying tape 125 to a rotating container such as 50, and a plurality of guide rollers 126, 127, and 130, for guiding the tape 125 from the tape supply 123 to the taping roller 124, and for presenting the tape 125 to the taping roller 124 and to a container such as 50 at an appropriate tension.

FIG. 18 further illustrates that the invention includes means operatively associated with the brake shoe 122, and responsive to the tape supply 123, for braking or releasing the tape supply hub 121 and the tape supply 123 to maintain a proper tension on the tape 125 being applied to a container 50. As illustrated in FIGS. 18 and 19, this responsive tensioning means comprises the arm 131 connected to both the brake shoe 122 and to the guide roller 126. The arm 131 is partially pivotable against the brake shoe 122 as tape 125 passes the guide roller 126. As a result, the tension of tape 125 against the guide roller 126 urges the arm 131 to pivot with respect to the brake shoe to thereby apply or release pressure to the brake shoe and thereby brake or release the hub 121 and the tape supply 123.

FIG. 18 shows that the arm 131 is further controlled by two springs 132 and 133, respectively. These springs urge the arm 131 in a counterclockwise direction as illustrated in FIG. 18, although it will be understood that the choice of clockwise or counterclockwise rotation is not significant other than in relation to the arrangement of the guide rolls. In turn, the pull of the tape 125 in the illustrated arrangement will urge the arm 131 to rotate in a clockwise direction. Thus, the effect of the arm on the brake shoe 122 is alternatively moderated by either an excess of tape pressure, or an excess of urging by the springs 132 and 133. As a result, the action of all these cooperating elements properly controls the tension on the tape 125.

In further detail, FIG. 18 shows that the arm 131 is connected to a moderating member 134 which is positioned between the two C-shaped clamps 135 and 136 that together make up the brake shoe 122. As seen from the shape of the moderating member 134, the pull of the tape 125 that carries the arm 131 in a clockwise direction will cause the moderating member 134 to rotate upon the pin 137. In turn, this rotation spreads the jaw portions of the C-shaped clamps 135 and 136 which in turn provides a braking action on the supply hub 121. Alternatively, when the tape 125 is not exerting as much pressure on the roller 126, the spring 132 urges the C-shaped clamps 135 and 136 to be somewhat separated from one another and release the braking pressure on the brake shoe 122 and supply hub 121. FIG. 18 shows that the C-shaped member 135 pivots on a pin 140 and the C-shaped member 136 pivots on another respective pin 141 to carry out the action just described.

Figure 21:
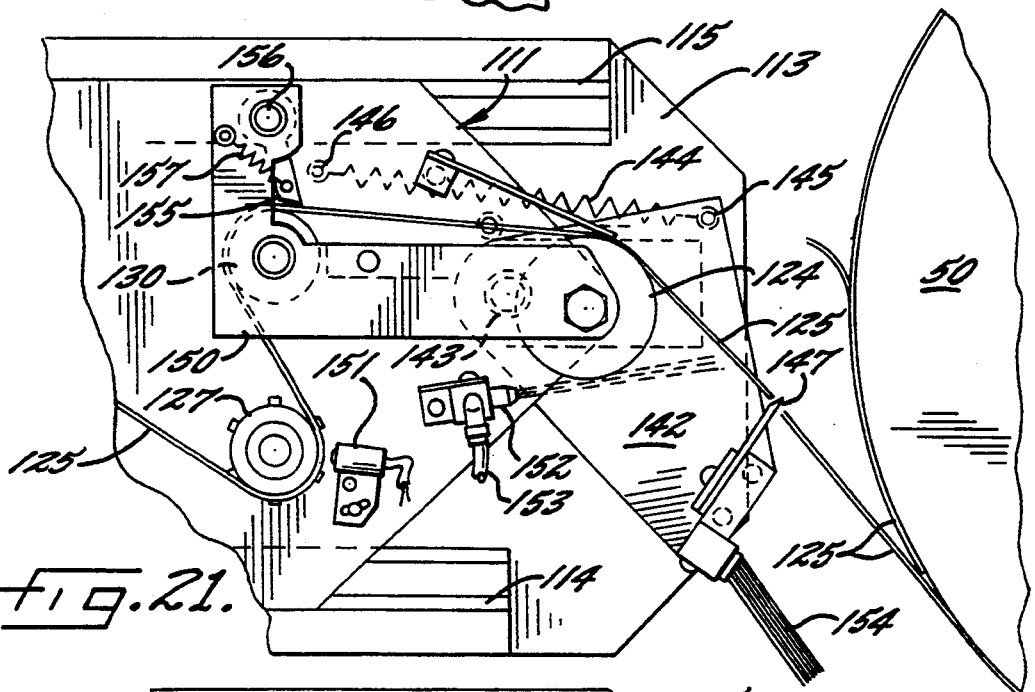
FIG. 21 is a partial top plan view of the tape cutting mechanism and showing the tape being severed.
Figure 22:
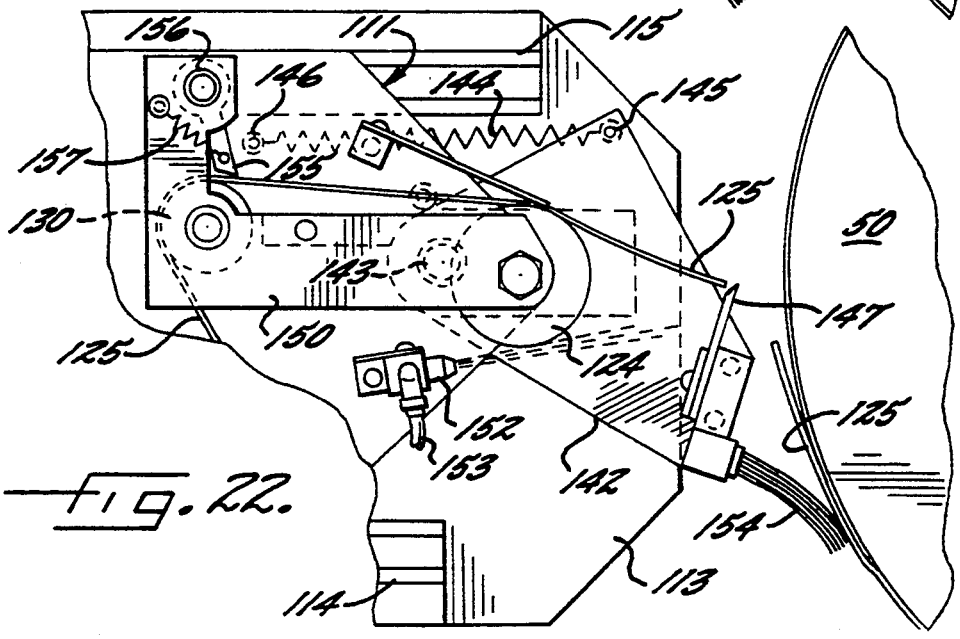
FIG. 22 is another top plan view of the mechanism identical to that of FIG. 21 but with the tape application action of the apparatus having progressed somewhat as illustrated therein.

The horizontal platform 111 also includes means adjacent its taping end for severing tape from the tape supply 123 at a container such as 50 when a predetermined length of tape 125 has been applied to the container to seal it. The severing means is best illustrated in FIGS. 18, 21, and 22. In the preferred embodiment, the severing means comprises a blade plate 142 that is pivotally mounted on the stationary plate 113 by a pivot pin 143. A spring 144 is connected to the blade plate 142 by another pin 145 and in turn is connected to the horizontal platform 111 by another pin 146. The blade plate 142 is adjacent the taping end of the horizontal platform 111 in order to be pivoted with respect to the horizontal platform 111 and with respect to tape 125 being applied to a container. A blade 147 is mounted on the blade plate 142 for severing tape 125 from the tape supply as illustrated in FIGS. 21 and 22.

An L-shaped pivot arm 150 is connected to the blade plate 142 and to the horizontal platform 111. As a result, movement of the horizontal platform 111 towards the retracted position pulls the pivot arm 150 rearwardly. In turn, the pivot arm 150 urges the blade plate 142 and the blade 147 to pivot towards, and then to sever, the tape 125 adjacent a container such as 50 after a predetermined length of tape has been applied to the container.

FIGS. 21 and 22 illustrate some additional details of the severing mechanism. First, a photodetector 151 is positioned adjacent guide roller 127 and literally counts the rotations of guide roller 127. This information can be quickly translated by an encoder or microprocessor into a measurement of tape length in any conventional manner known to those of skill in the art. The photodetector 151 and guide roller 127 thus provide the means for applying a predetermined length of sealing tape to successive containers as they reach and are held at the holding means by basing the length of tape applied upon the rotation of the guide roller 127. Because the guide roller 127 rotates as sealing tape passes around it and then to and around the rotating container 50, the length of tape applied is in turn based upon the rotation of the container 50. This arrangement provides a more accurate application of sealing tape because it is based upon the sealing of each individual container, rather than an arbitrary length which, even if selected on the basis of the circumference of the container, could be misapplied and leave an unacceptable gap.

The invention also includes an air nozzle 152 connected to an air supply (not shown) by a hose 153. The air nozzle 152 directs a stream of air past guide roller 124 and against the rear, nonadhesive portions of the tape 125. In this manner, the stream of air from the nozzle 155 helps maintain the tape 125 in a position to come into contact with each successive container as they reach the taping position.

FIGS. 21 and 22 also show that the blade plate 142 carries a brush 154 which in the illustrated embodiment is carried adjacent and at right angles to the blade 147. As particularly illustrated in FIG. 22, as the blade plate 142 rotates and the blade 147 severs the tape 125, there will be a small portion or tail of the tape 125 that extends from the can 50. As the container 50 rotates, however, and as the blade plate 142 similarly rotates, the brush 154 moves from its position in FIG. 21 to its position in FIG. 22 and brushes the tail end of the tape 125 against the container 50 to complete the taping cycle.

The taping mechanism also includes a tape stopping arm 155 adjacent the guide roller 130. The arm 155 pivots on a pin 156 and is urged against the tape by the spring 157. The arm 155 keeps tape appropriately adjacent guide roller 130 on its way to guide roll 124 and to the blade 147 even though tension would not otherwise be maintained on the tape at this point, particularly once the tape is severed from the can in the manner illustrated in FIG. 22.

CONTAINER INDEXING

The invention further comprises a sensor operatively associated with the advancing means and with the holding means for determining the presence and position of successive containers with respect to the holding means. In particular, the sensing means are adjacent the conveyor 31 and identify the presence of containers such as 45, 46 and 47 at one or more predetermined positions along the conveyor 31. The sensors and their positions are best illustrated in FIG. 2 in which a first sensor 160 is illustrated as a photodetector working in conjunction with a mirror 161 opposite it across the conveyor 31. A second photodetector 162 is positioned adjacent the taping means, and in conjunction with mirror 163 can identify the position of a container such as 50 at the taping position. A third photodetector 164 is downstream of the photodetector 162 and likewise uses mirror 163 to identify the position of containers at the taping position. In conjunction with an encoder or microprocessor, the photodetectors determine whether a container is present at the taping position, at an indexed position upstream of the taping position, at both, or at neither.

FIG. 2 also illustrates a set of indexing pins 165 and 166. The indexing pins are upstream of the tape head and have portions that reciprocate perpendicularly into and out of the path of travel of the conveyor 31 to prevent containers such as 47 and 50 from passing and reaching the tape head until the pin 166 reciprocates out of the path of travel. FIG. 2 thus illustrates that the first photodetector 160 is upstream of the tape head and identifies the presence of a container such as 47 immediately upstream of the tape head. The second photodetector 162 is adjacent the tape head for identifying the presence of a container such as 50 at the tape head. In this embodiment, the first indexing pin 166 is downstream of the first photodetector 160 and upstream of the second photodetector 162. The second indexing pin 165 is upstream of the first indexing pin 166 so that the first and second indexing pins 166 and 165 together define an indexing zone upstream of the tape head. As illustrated in FIG. 2, the container designated at 47 is in this indexing zone. The indexing pins and the photodetectors are operatively associated so that the pins 165 and 166 reciprocate in response to the presence or absence of containers in the indexing zone and at the tape head. With such cooperation, a single container is permitted to advance to the tape head, two successive containers are indexed with one at the taping position and one in the indexing zone, and three or more successive containers will be indexed with one at the taping position, one in the indexing zone, and the remainder (e.g. 45 and 46 in FIG. 2) upstream of the indexing zone. Containers are thus successively advanced from upstream into the indexing zone and then to the tape head as preceding containers are taped and released from the tape head.

It will thus be seen that the apparatus provides a method of sealing containers so that they can be sealed while being advanced in a substantially horizontal, substantially linear path of travel. The method comprises advancing a plurality of containers in successive fashion along a substantially linear, substantially horizontal path of travel, temporarily holding a successive container in a stationary position along the path of travel, engaging a tape supply against the container, rotating the container to draw the tape into sealing position around the container to thereby apply a tape seal to the container, and severing the applied tape from the tape supply. The method can further comprise the steps of detecting the presence of a container at the tape supply and indexing successive containers upstream of the tape supply for presentation to the tape supply in individual fashion.

In the drawings and specification, there have been disclosed typical preferred embodiments of the invention, and, although specific terms have been employed, they have been used in a generic and descriptive sense only and not for purposes of limitation, the scope of the invention being set forth in the following claims.

That which is claimed is:

1. A container sealer for successively applying a sealing tape to a container and its lid comprising:

a conveyor for advancing a plurality of containers in successive fashion along a substantially linear, substantially horizontal predetermined path of travel, said conveyor defining a downstream direction in which said conveyor travels and an upstream direction opposite to said conveyor's direction of travel;

sensing means along said conveyor for determining whether one or more containers are adjacent one or more predetermined positions along said conveyor;

a tape head along said conveyor and cooperating with said sensing means, said tape head being movable between a taping position adjacent the predetermined path of travel of said conveyor and a retracted position removed somewhat from the predetermined path of travel of said conveyor, for applying a length of tape to a container when a container is adjacent said tape head;

a pair of idler rollers positioned above said conveyor and adjacent to and downstream from said tape head, and that are responsive to said sensing means, said idler rollers being moveable between a closed position wherein said idler rollers are less than one container diameter apart to thereby prevent a container from passing therebetween, and an open position in which said idler rollers are greater than one container diameter apart to thereby allow a container to pass therebetween, for holding an advancing container along said conveyor when the container is adjacent said tape head, for permitting a container to rotate while being held and taped, and for releasing the container downstream thereafter;

a drive roller positioned above said conveyor and adjacent to and upstream of said tape head, and that is responsive to said sensing means, said drive roller being moveable between a drive position that is above said conveyor and in said predetermined path of travel, and a passage position that is alongside said conveyor, said drive roller being further positioned to engage and rotate a container when said idler rollers are in their closed position and said drive roller is in its drive position; and indexing means adjacent said conveyor and operatively associated with said sensor, said tape head, said idler rollers and said drive roller for ordering successive containers along said conveyor and advancing individual containers to said tape head for taping.

2. A container sealer according to claim 1 further comprising vertical and horizontal adjustment means for vertically and horizontally adjusting the closed position of said idler rollers in relation to said conveyor to thereby hold and seal containers of varying diameters and varying heights.

3. A container sealer according to claim 1 further comprising vertical and horizontal adjustment means for vertically and horizontally adjusting the drive position of said drive roller in relation to said conveyor to thereby rotate and seal containers of varying diameters and varying heights.

4. A container sealer according to claim 1 wherein said tape head is horizontally movable between the respective taping and retracted positions.

5. A container sealer according to claim 1 wherein said sensing means comprises a photosensor upstream from said tape head.

6. A container sealer according to claim 1 wherein said indexing means comprises an indexing pin upstream of said tape head that reciprocates perpendicularly into and out of said predetermined path of travel of said conveyor to prevent containers from passing said pin and reaching said tape head until said pin reciprocates out of said predetermined path of travel.

7. A container sealer according to claim 1 wherein said sensing means comprises:

a first photodetector upstream of said tape head for determining whether a container is immediately upstream of said tape head; and a second photodetector adjacent said tape head for determining whether a container is adjacent said tape head;

and wherein said indexing means comprises:

a first indexing pin downstream of said first photodetector and upstream of said second photodetector; and a second indexing pin upstream of said first indexing pin so that said first and second indexing pins together define an indexing zone upstream of said tape head;

and wherein said indexing pins and said photodetectors are operatively associated so that said pins reciprocate in response to the presence or absence of containers in said indexing zone and adjacent said tape head, so that a single container will be permitted to advance to said tape head, two successive containers will be indexed with one adjacent said tape head and one in said indexing zone, and three or more successive containers will be indexed with one adjacent said tape head, one in said indexing zone, and the remainder upstream of said indexing zone, and wherein containers will be successively advanced from upstream into said indexing zone and then to said tape head as preceding containers are taped and released from said tape head.

8. A container sealer according to claim 1 wherein said tape head further comprises:

a horizontal platform mounted adjacent said conveyor for moving between said taping position and said retracted position, and with one end of said platform defining a taping end and the opposite end of said platform defining a supply end;

a driving cylinder for driving said platform between said taping position and said retracted position;

a tape supply hub on said platform adjacent said supply end;

a brake shoe for bearing against and braking said hub;

a tape supply on said supply hub;

tape directing means for directing tape from said tape supply to a container when a container is adjacent said tape head;

tensioning means responsive to said tape supply and operatively associated with said brake shoe for braking or releasing said tape supply hub and said tape supply to maintain a proper tension on tape being applied to a container; and severing means adjacent said taping end of said platform for severing tape from said tape supply when a predetermined length of tape has been applied to a container to seal it.

9. A container sealer according to claim 8 wherein said hub and said brake shoe are both substantially circular.

10. A container sealer according to claim 8 wherein said tape directing means comprises:

a taping roller coupled to said taping end of said horizontal platform for applying tape to a rotating container; and a plurality of guide rollers between said tape hub and said taping roller for guiding tape from said tape supply to said taping roller and introducing tape to said taping roller and to a contianer with an appropriate tension.

11. A container sealer according to claim 10 wherein said tensioning means comprises an arm connected to said brake shoe and a guide roller on said arm, said arm being partially pivotable against said brake shoe as tape passes said guide roller so the tension of the tape against said guide roller urges said arm to pivot in relation to said brake shoe to thereby apply pressure to or release pressure from said brake shoe and thereby brake or release said hub and said tape supply.

12. A container sealer according to claim 8 wherein said horizontal platform is slidably moveable and further comprises:

a supporting member adjacent said conveyor;

a horizontally oriented stationary plate on said supporting member and substantially parallel to and beneath said horizontal platform;

a pair of parallel tracks on said stationary plate; and a pair of rails depending from said horizontal platform and slidably positioned against said respective parallel tracks for permitting said horizontal platform to slide in relation to, and in parallel orientation with, said stationary plate.

13. A container sealer according to claim 12 wherein said driving cylinder is positioned between said platform and said stationary plate, and is connected to both said stationary plate and said horizontal platform for moving said horizontal platform in relation to said stationary plate.

14. A container sealer according to claim 12 wherein said severing means comprises:

a blade plate pivotably mounted on said stationary plate adjacent said taping end of said horizontal platform for being pivoted in relation to said horizontal platform and in relation to tape being applied to a container;

a blade mounted on said blade plate for severing tape from the tape supply; and a pivot arm connected to said blade plate and to said horizontal platform so that movement of said horizontal platform towards said retracted position pulls said pivot arm, and said pivot arm in turn urges said blade plate and said blade to pivot towards and then sever the tape adjacent a container after a predetermined length of tape has been applied to the container.

* * * * *

UNITED STATES PATENT AND TRADEMARK OFFICE

CERTIFICATE OF CORRECTION

PATENT NO. : 5,367,855

DATED : November 29, 1994

INVENTOR(S) : DeWaters

It is certified that error appears in the above-identified patent and that said Letters Patent is hereby corrected as shown below:

IN THE ABSTRACT:

On line 16, after "adjacent" insert -- the --.

In column 3, line 33, after "31" omit the period (.).

In column 3, line 68, before "adjusting" omit the comma (,).

In column 4, line 65, "3" should be -- 31 --.

In column 8, line 6, "155" should be -- 152 --.

In column 12, line 8, "the" (first occurrence) should be -- that --.

Signed and Sealed this

Seventh Day of March, 1995

Bruce Lehman

*Attest:*

BRUCE LEHMAN

*Attesting Officer*

*Commissioner of Patents and Trademarks*